United States Patent [19]

Corbett

[11] Patent Number: 4,759,660

[45] Date of Patent: Jul. 26, 1988

[54] ADJUSTABLE SHORING SYSTEM FOR BOATS

[76] Inventor: Reg D. Corbett, 23116 Roberts Run, Bay Village, Ohio 44140

[21] Appl. No.: 36,578

[22] Filed: Apr. 10, 1987

[51] Int. Cl.[4] ..... B63C 5/05

[52] U.S. Cl. ..... 405/7; 248/354.3; 405/3

[58] Field of Search ..... 405/1, 3, 4, 7; 114/44, 114/45; 248/351, 354.1, 354.3, 357; 269/296

[56] References Cited

U.S. PATENT DOCUMENTS

| | | | |
|---|---|---|---|
| 3,326,007 | 6/1967 | Burnett | 405/7 |
| 3,347,543 | 10/1967 | Zak | 269/296 |
| 3,586,285 | 6/1971 | Modzelewski | 405/7 X |
| 4,155,667 | 5/1979 | Ebsen | 405/7 |
| 4,468,150 | 8/1984 | Price | 405/7 |

FOREIGN PATENT DOCUMENTS

| | | | |
|---|---|---|---|
| 2092529 | 8/1982 | United Kingdom | 405/7 |
| 1232564 | 5/1986 | U.S.S.R. | 405/7 |

*Primary Examiner*—David H. Corbin

[57] ABSTRACT

A boat shoring system for cradling and supporting a boat in dry storage comprising two or more interconnected sub-system assemblies. Each sub-system comprises a central load bearing post and two laterally spaced outside supporting stands securely interconnected with laterally adjustable and angularly directed cable or chain means tautly stretched and preferably in tension to stabilize lateral movement. Two adjacent sub-systems are further stabilized by tautly stretched center cable means. The load bearing posts and outside supporting stands are vertically adjustable and transversely movable both laterally as well as forwardly and rearwardly. The boat shoring system can be easily assembled for use or dismantled into individual components and compactly stored during non-use.

21 Claims, 4 Drawing Sheets

ADJUSTABLE SHORING SYSTEM FOR BOATS

BACKGROUND OF THE INVENTION

This invention pertains to a system of shoring posts and supporting stands useful for storing boats out of water and particularly to a boat shoring system comprising individually adjustable and collapsible shoring posts and supporting stands securely interconnected with stabilizing cables to provide a boat cradle or support system readily adjustable to support variable size boat hulls removed from water.

Supporting systems or boat cradles for supporting boats in dry storage are known. For instance, U.S. Pat. No. 3,586,285 and U.S. Pat. No. 4,468,150 disclose boat blocks and boat cradles comprising fixed dimension wooden base members resting on the ground with adjustable vertical supports secured at the distal ends of fixed lateral members for supporting the hull section of a boat while U.S. Pat. No. 3,430,911 discloses laterally adjustable posts resting on a fixed lateral cross-beam. Similarly, U.S. Pat. No. 3,139,277 and U.S. Pat. No. 4,155,667 disclose adjustable support members for supporting a boat hull with a center keel. In said U.S. Pat. No. 4,155,167, sailboats are supported by vertical posts interconnected to a series of horizontal stabilizing pipes.

The prior art devices, however, are deficient in that the boat shoring structures are unstable, particularly with high center of gravity larger boats, and are not easily adjustable to accomodate various size boat hulls. Stabilizing heavy and bulky boat hulls against inadvertent shift requires equalizing and balancing supporting forces particularly important in maintaining safe storage of boats. Further, prior art showing structures are not easily dismantled for storage during non-use.

It now has been found that a plurality of individually adjustable shoring posts or stands can be independently adjusted both vertically and transversely to safely support a wide variety of boat hulls of different widths, lengths and heights. The individual shoring stands are securely stabilized with angularly directed lateral stabilizing cables or chains in conjunction with similar horizontally disposed stem to stern center cables or chains. The boat shoring system of this invention comprises two or more sub-systems where each sub-system includes a vertically adjustable central load bearing post adapted to support the keel of the vessel in combination with outer adjustable spaced shoring stands particularly directed inwardly on a vertical bias toward the central load bearing post to engage and support the boat. The interconnecting cables or chains prevent ground slippage of individual outer shoring stands in the system while the entire weight of the boat is supported evenly by the entire shoring system. The individually stabilized outer biased shoring stands provide inwardly directed biased supporting forces while being securely chained to prevent lateral ground movement thereof. The entire shoring system can be easily assembled and adjusted vertically and transversely for use or easily dismantled for compact storage of the individual parts thereof. These and other advantages of this invention will become more readily apparent by referring to the accompanying drawings as described in the appended specification.

SUMMARY OF THE INVENTION

Briefly, the boat shoring system of this invention comprises a plurality of interrelated supporting means adapted to be both vertically and transversely adjustable and securely anchored together by means of interconnecting cables or chains. The boat shoring system comprises at least two interconnected sub-systems where each sub-system contains a central load bearing post adapted to engage the central beam member of the boat hull in conjunction with at least two outwardly extending supporting stands disposed on either side of the central load bearing post and adapted to support the boat hull generally. The two outer supporting stands are particularly biased inwardly with inside legs thereof biased and shorter than outside biased legs thereof to off-set and stabilize the angular weight force imparted by the hull and supported by each outside supporting stand.

IN THE DRAWINGS

Figure 4:
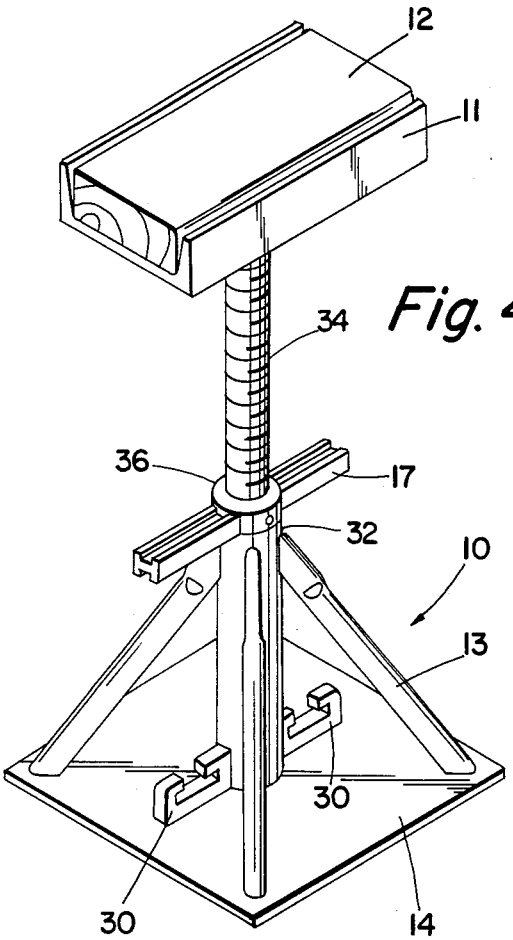
FIG. 4 is a vertical perspective view of a central load bearing shoring post of the boat shoring system.
Figure 6:
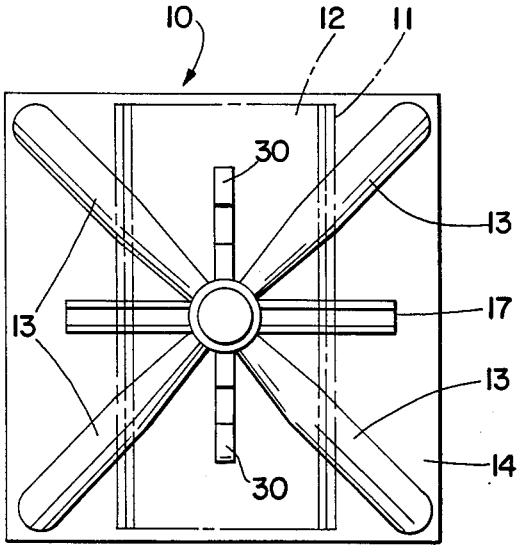
Figure 7:
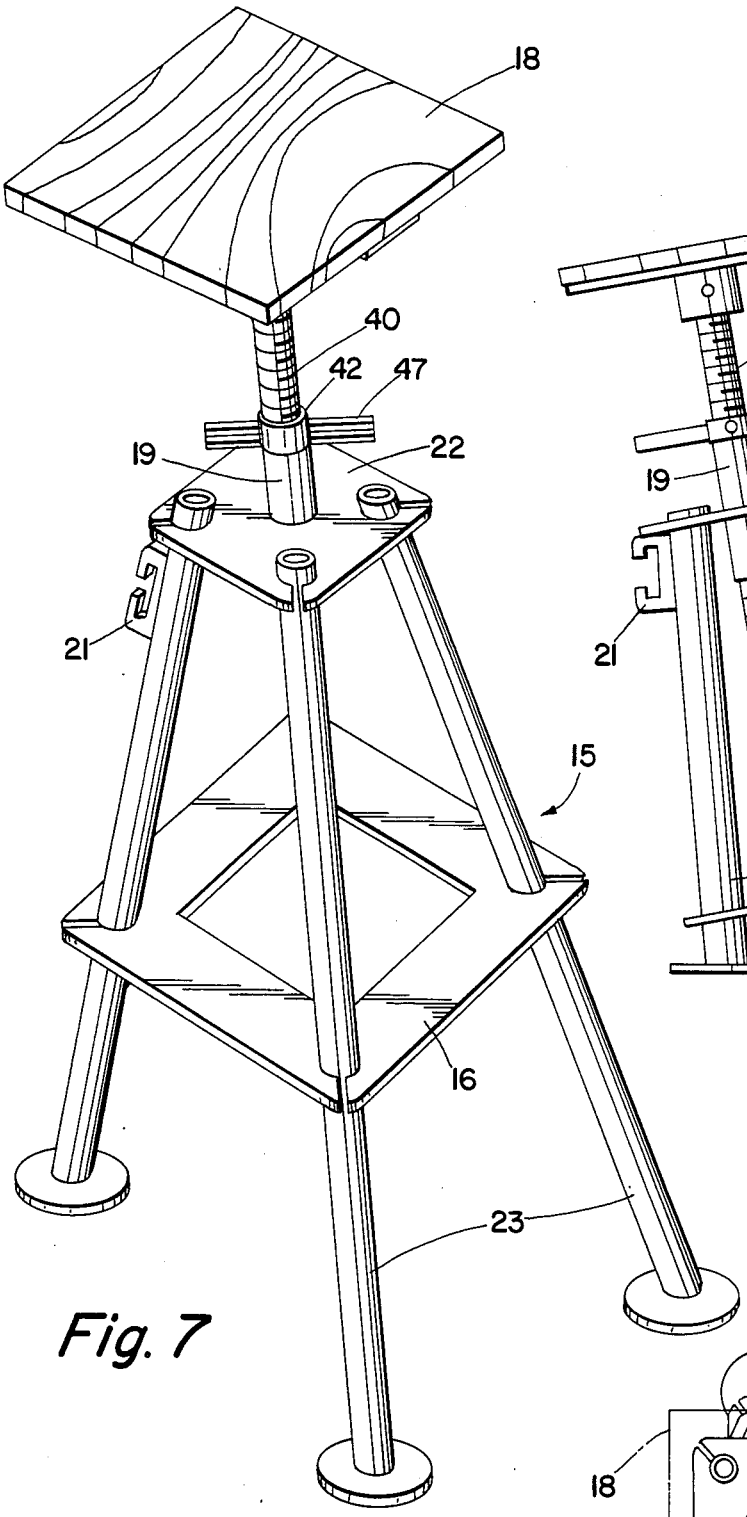
Figure 8:
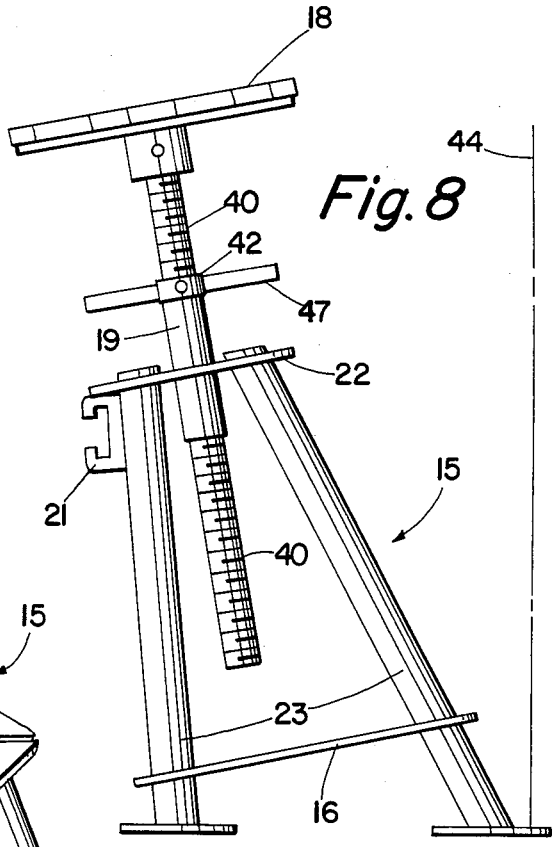
Figure 9:
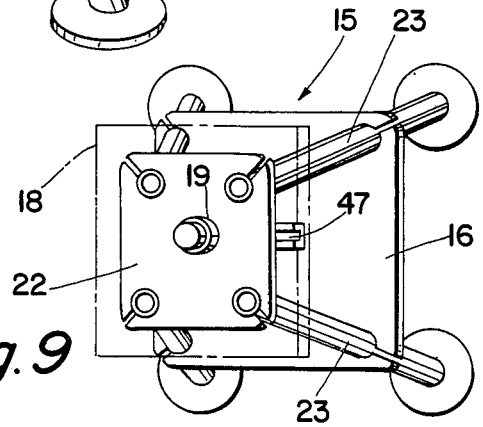

FIG. 6 is a top plan view of the central load bearing shoring post shown in FIG. 4 with member 17 rotated 90° and the upper load bearing block 12 removed and shown in phantom lines;

FIG. 7 is a vertical perspective view of a biased outside supporting stand of the boat shoring system;

FIG. 8 is a front elevation view of the biased outside supporting stand shown in FIG. 7; and FIG. 9 is a top plan view of the biased outside supporting stand shown in FIG. 8 with the upper supporting block removed and shown in phantom lines.

DETAILED DESCRIPTION OF THE INVENTION

Figure 1:
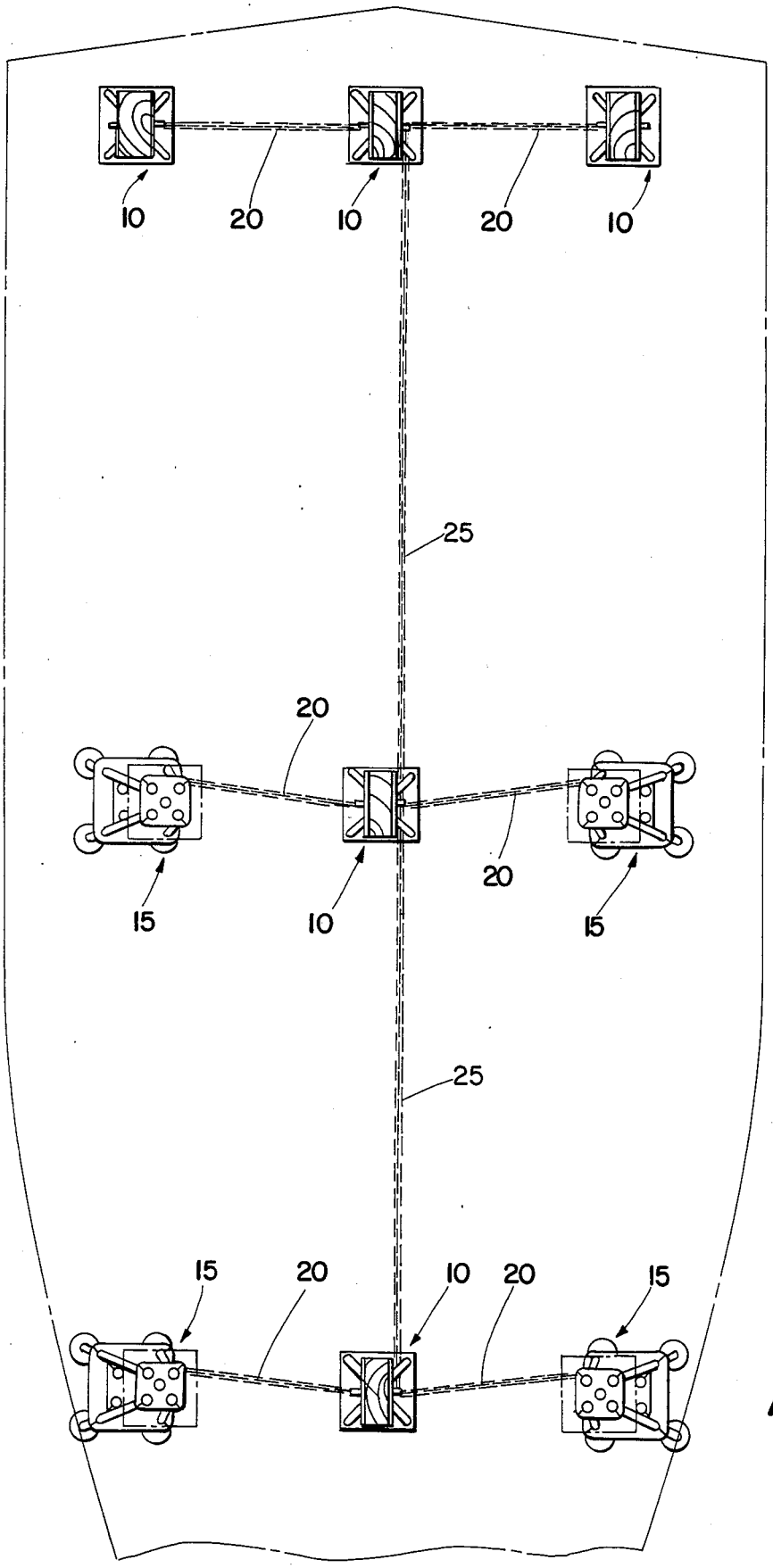
FIG. 1 is a plan view of the boat shoring system of this invention supporting a boat hull as shown in phantom lines.

Referring now to the drawings wherein like reference characters indicate like parts, FIG. 1 illustrates a boat shoring system of this invention shown in plan view the boat hull supported thereby being shown in phantom lines. As viewed in FIG. 1, the boat hull depicts the stern of the hull at the top of the drawing and the bow portion at the bottom of the drawing.

Figure 2:
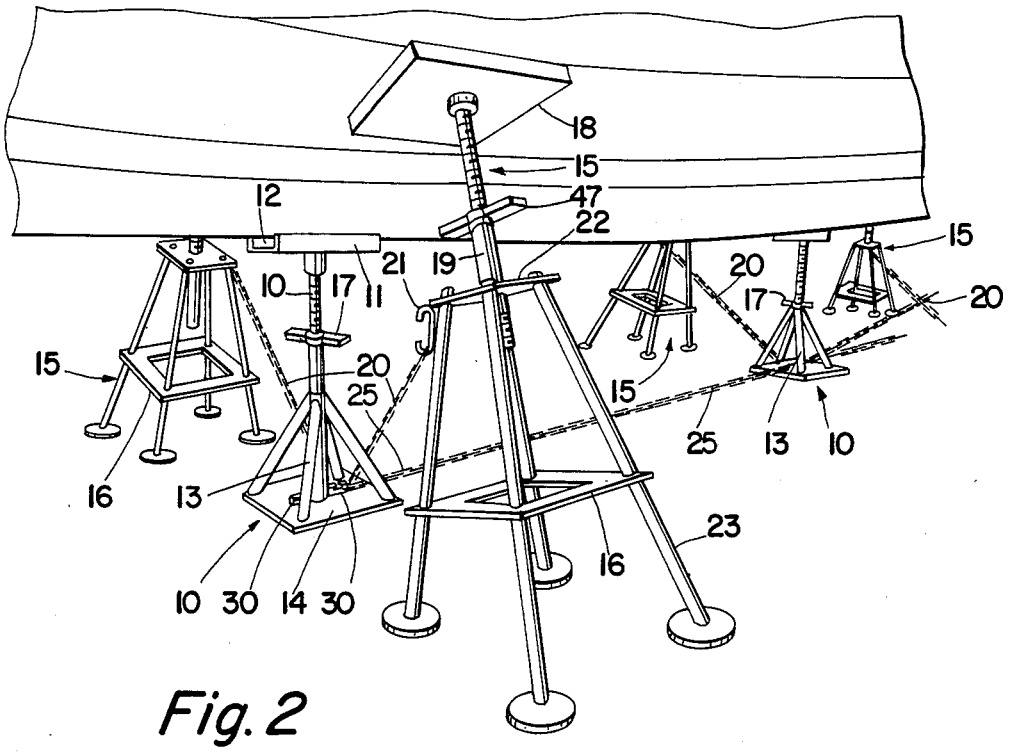
FIG. 2 is a partial perspective view of the boat shoring system showing a forward sub-system assembly interconnected with rearwardly disposed partial sub-systems supporting a portion of a boat hull.
Figure 3:
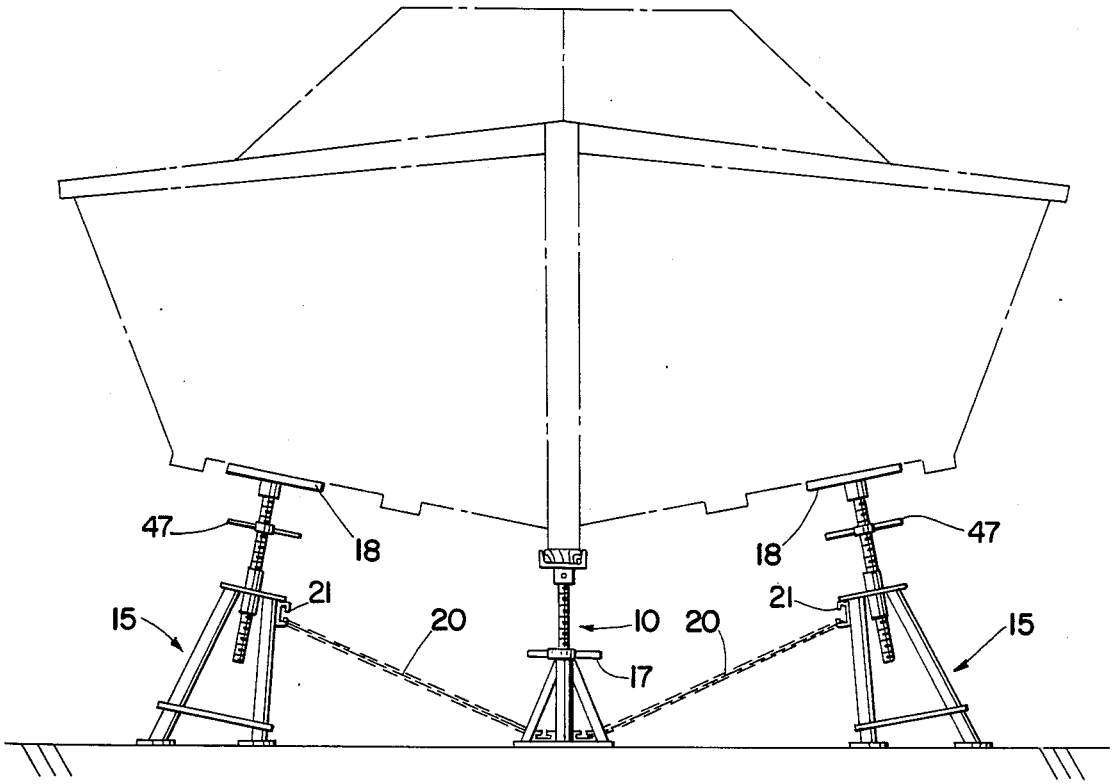
FIG. 3 is a front vertical view of a single sub-system assembly of the boat shoring system with the stern or bow of the boat shown in phantom lines.

The boat shoring system of this invention comprises a plurality of individual vertically disposed shoring parts adapted to support the boat hull. The boat shoring system comprises two or more sub-systems wherein each sub-system preferably comprises a central load bearing shoring post 10 interconnected with a pair of outer biased supporting shoring stands 15 by lateral cables or chains 20. For supporting the boat hulls, the boat shoring system can include a plurality of load bearing shoring posts 10 as indicated supporting the keel portion of the boat hull in FIG. 1. Each standard sub-section includes lateral cables or chains 20 interconnecting the central load bearing posts 10 and said posts with adjacent outside biased supporting stands 15. The lateral cable means or chains 20 are literally adjustable and preferably interconnected between the lower base portion, preferably the base plate 14 of the posts 10 and the upper portion of each outside supporting stand 15 in such a manner as to maintain a taut angular interconnection, preferably in tension as best viewed in FIG. 3. As shown, hooks 21 on posts 15 are used to anchor chains 20 secured as by hooks 30 to the central load bearing shoring posts 10 to adjacent sub-systems. The posts 10 are interconnected by a taut center cable means or chain 25 between the lowermost base portion or base plate 14 of each such central load bearing post 10 while maintaining each center cable or chain 20 horizontally close to the ground as best viewed in FIG. 2.

Figure 5:
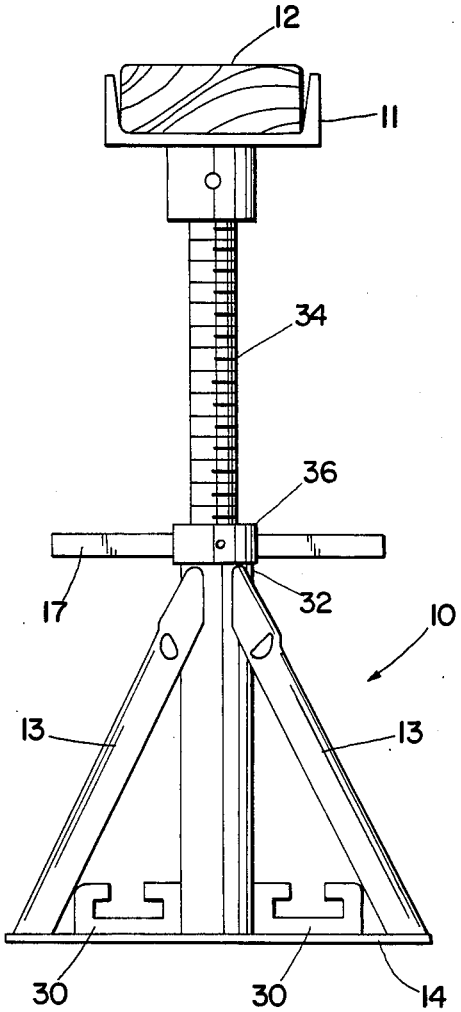
FIG. 5 is a side elevation view of the central load bearing shoring post shown in FIG. 4.

FIGS. 4, 5 and 6 disclose in more detail a preferred embodiment of the central load bearing shoring post 10. The central shoring post 10 contains a horizontal base plate 14 preferably of heavy metal supporting a centrally located vertical tube 32 for receiving and supporting an adjustable threaded screw-lift load bearing member 34. The screw-lift member 34 contains outside threads adapted to be engaged by inside threaded member 36 adapted to be manually rotated 360° by adjusting crank means 17 to move the screw-lift member 34 upwardly or downwardly as desired. The uppermost end of the screw-lift member 34 is secured to a holding means 11 preferably having a wooden load bearing block 12 seated thereon for engaging the hull surface. The vertical tube 32 is supported by a plurality of bracing members 13 secured to the upper part of the vertical tube 32 and at their lower ends to the outer periphery of a flat horizontal base 14 for the post. The pair of cable or chain anchoring or hook means 30 disposed on the base 14 are adapted to receive an end of a chain 20 and said hooks are welded or otherwise secured to the base plate 14 and preferably further secured to an upper portion of the vertical tube 32 by similar means.

FIGS. 7, 8 and 9, further depict in further detail the preferred construction of the outside biased supporting stand 15. The outside supporting stand 15 contains four spaced leg members 23 maintained in a spaced relationship by an intermediate bracing plate 16 and an upper bracing plate 22. A center support tube 19 projects through an opening in the upper bracing plate 22 and said tube 19 is adapted to receive an exterior threaded support or screw-lift member 40 fitted within the short center support tube 19.

The threaded screw-lift support member 40 is operative to move upwardly or downwardly within the tube 19 by rotating an interior threaded collar 42 operative by rotating hand crank means 47 attached to the collar 42. As best shown in front elevational view in FIG. 8, the outer supporting stand 15 is disposed at an angle and/or biased inwardly with relatively longer angled outer legs and relatively shorter less angled or biased inner legs 23. The outside support stand 15 is angled or biased from a vertical line whereby threaded member 40 provides an angled support member having a large, flat, wooden supporting block 18 adapted to engage a center portion of the boat hull. The top plan view shown in FIG. 9 shows the supporting block 18 removed from the stand and in phantom lines further illustrates the degree of bias off-set from the vertical where the off-set is directed inwardly as viewed in FIGS. 8 and 3. A cable or chain anchor means or hook 21 is secured to the upper part of one of the shorter inner leg members 23 and is adapted to engage and secure a lateral cable or chain 20 tautly stretched between each outside stand 15 and a common central keel load bearing post 10 to comprise a sub-system assembly. Accordingly, two or more sub-systems are interconnected by a center chain 25 tautly interconnected between two or more central load bearing shoring posts 10. As best viewed in FIG. 3, lateral cable means or chains 20 are anchored to the bottom base member 14 of the common central post 10 and stretched upwardly and outwardly on an angle to securely engage anchor means 21 secured to the upper part of each outside supporting stand 15.

As shown in the preferred form of this invention illustrated in FIG. 1, the boat shoring system comprises two sub-system assemblies supporting the forward end of the boat hull with a plurality, preferably three, of load bearing posts 10 supporting the boat hull. The two forward and intermediate sub-systems each comprise a central keel load bearing post 10 in combination with two outside biased support stands 15 adapted to support either of the surfaces of the boat hull. The stern position load bearing posts 10 are adapted to support the relatively flat profile surface of the stern section boat hull. Where three load bearing posts 10 are utilized for the stern section, the center post engages the center beam or keel of the hull and is considered a central load post 10 whereas the central end posts 10 are considered support posts 10.

It is readily seen that the boat shoring system of this invention provides stabilized and balanced support to just about any size boat hull. The major weight force is a vertically downwardly directed force through the keel which is supported by the central load bearing post 10. Providing stabilized support to the forward portion of the boat hull requires biased supporting stands 15 and thus the upper supporting block 18 is tangentially orientated to the curved hull surface and essentially perpendicular to the load bearing threaded member 40 secured within the central support tube 19. As best viewed in FIG. 8, the inner leg members 23 are less angled or biased than the outer leg members 23 and the outer leg members 23 are at a greater angle to the vertical than the angle to the vertical of the load bearing threaded member 40 within the tube 19. The downward thrust of the boat weight is directed primarily on the outermost legs 23 although considerable weight is supported by the innermost legs 23 of each biased stand 15. To prevent lateral movement of the biased supporting stands 15 in use, lateral cables or chains 20 are tautly secured between upper anchor means 21 secured to the biased stands 15 and to the lower anchor means or hook 30 on the base plate 14 of the central load bearing post 10 whereby a structural triangle is formed between the ground, the central post 10, and each angled supporting stand 15. The downward vertical force on the central load bearing post 10 literally renders that point of the triangle immovable while the taut lateral chain renders the top or apex of the triangle immovable and the downward biased force on each biased support stand 15 renders the third ground point of the triangle immovable. Hence, the downward weight forces of the boat hull through each central post 10, in conjunction with both biased side stands 15, comprising a sub-system, advantageously promotes stability to the sub-system and particularly stabilizes the bias forces through the different skewed biases of the innermost legs 23 and outermost legs 23 with the central load bearing threaded member 40 at a bias less than the outside legs 23 but more than the bias of the inside legs 23. It should be further noted that the structural configuration of each biased outside stand 15 in itself forms a structural triangle comprising a load bearing point forming the upper point while the distal opposite ends are formed by ground resting points of the inner and outer legs 23. The third side of the triangle is formed by the ground between said respective ground or floor resting points of the inner and outer legs 23.

In use, the boat shoring system is easily assembled from a plurality of central posts 10 with complementary outside biased supporting stands 15 interconnected with lateral cables or chains 20 and center cables or chains 25, depending on the number of sub-systems utilized. Two or more central load bearing posts 10 are aligned with the keel or central beam member of the boat hull A center cable or chain 25 is stretched tautly between each pair of central posts 10 and secured therebetween by locking engagement with the respective anchor means 30 secured to the base plate 14 whereby the center cables or chains 25 are maintained substantially horizontal and close to ground level. Each central post 10 is a load bearing post and provides the center post for each sub-system assembly. The vertical height of each central post 10 can be adjusted by rotating the adjusting crank 17.

Each sub-system comprises a central load bearing post 10 interconnected with a pair of complementary side supporting posts 15 disposed laterally of and above on either side of the central post 10. Lateral side cables or chains 20 securely anchored to the base plate 14 of the central post 10 are stretched upwardly on an angle and tautly secured to anchor means 21 welded to the upper portion of each outer biased supporting stand 15. The boat hull dead weight is distributed primarily on the central load bearing posts 10 and partially distributed on each of the angled or biased outer supporting stands 15. The dead weight of the boat hull increases the tension on the lateral cables or chains 20 as well as the center cable or chains 25 which further increases the stability in use of the boat shoring system of this invention. The boat shoring system is easily assembled for use with various size boat hulls and can be easily disassembled and compactly stored, while not in use.

Although the foregoing drawings and description discloses preferred embodiments of the boat shoring system of this invention, the scope of the invention is not intended to be limited except by the appended claims.

What I claim is:

1. A boat shoring system for supporting a boat out of water and in dry storage, the boat having a hull including a center keel, the boat shoring system being adapted to support the boat hull on a horizontal surface, the boat system comprising:

at least two sub-system assemblies, each sub-system comprising a central load bearing post in combination with two biased outside supporting stands where each said supporting stand is located laterally opposite and above the central load bearing post;

said central load bearing post having upper load bearing means for engaging the keel of the boat hull, said load bearing means secured to a vertically adjustable load bearing member operatively supported by a base plate adapted to rest on the said horizontal surface;

each said biased outside supporting stand comprising a supporting block secured to an upwardly adjustable elongated support member skewed inwardly relative to a vertical line, said supporting block having an upper surface substantially perpendicular to said skewed elongated member and adapted to engage the boat hull, said outside support stand having a pair of outside legs and a pair of inside legs secured to an upper bracing structure adapted to operatively support said skewed elongated member between the pair of outside legs and the pair of inside legs, said pair of inside legs being shorter than the pair of outside legs and skewed inwardly less than said skewed vertical member, and said outside legs being skewed inwardly more than said skewed vertical member;

each said biased outside support stand secured with a lateral cable means secured to the upper bracing structure of the outside support stand, and to the base plate of the central load bearing post to form a stabilizing angular cable connection between each biased outside support stand and the central load bearing post.

2. The boat shoring system in claim 1 wherein the central load bearing posts of adjacent sub-system assemblies are interconnected with a tautly stretched center cable means.

3. The boat shoring means in claim 2 wherein each center cable means is secured to the base plate of each adjacent central load bearing posts.

4. The boat shoring system in claim 1 wherein the boat shoring system comprises two sub-system assemblies adapted to support the forward two-thirds of the boat hull and at least one stern load bearing post for supporting the rearward stern portion of the boat hull.

5. The boat shoring system in claim 4 including a pair of stern load bearing posts adapted to support the rearward stern portion of the boat hull.

6. The boat shoring system in claim 4 where the stern load bearing posts comprise three laterally spaced load bearing posts including a central load bearing post adapted to engage the central beam member of the boat hull and two outside load bearing posts.

7. The boat shoring system in claim 6 wherein the stern central load bearing post is interconnected to an adjacent central load bearing post of an adjacent sub-system assembly with a tautly stretched center cable means.

8. The boat shoring system in claim 6 wherein the stern central load bearing post is interconnected with the two outside load bearing posts by a lateral cable means.

9. The boat shoring system in claim 6 wherein the center cable means and each lateral cable means interconnected to the stern central load bearing post are each secured to the base plate supporting the stern central load bearing post.

10. The boat shoring system in claim 9 wherein each lateral cable means connected to an outside load bearing post is connected to the base plate of the respective outside load bearing post.

11. The boat shoring system in claim 2 including three sub-system assemblies including a rearward stern sub-system for supporting the stern portion of the boat hull.

12. The boat shoring system in claim 11 where each central cable means is interconnected between the base plate of adjacent central load bearing posts.

13. The boat shoring system in claim 2 where each center cable means and each lateral cable means are each in tension while supporting the boat hull.

14. The boat shoring system in claim 1 where each said biased outside supporting stand is braced with an intermediate bracing means.

15. The boat shoring system in claim 2 where the central load bearing member of each central load bearing post is secured to the base plate and the respective lateral cable means secured to each central load bearing post is secured to an anchor means welded to both the base plate and the central load bearing member.

16. The boat sharing system in claim 2 where the central cable means and the lateral cable means are each adjustable and detachable from the central load bearing posts and from the biased outside supporting stands.

17. The boat shoring system in claim 2 where the vertically adjustable load bearing member of each central load bearing post is a screw-lift means operative to raise and lower the load bearing block.

18. The boat shoring system in claim 2 where the vertically adjustable support member of each outside support stand is a screw-lift means operative to raise and lower the supporting block.

19. A boat shoring system for supporting a boat having a boat hull in dry storage, the boat shoring system comprising:

a combination of two or more sub-system assemblies where each sub-system comprises a central load bearing post having an upper load bearing block adapted to engage the linear center of the boat hull and a pair of outside support stands where each stand is laterally spaced from the central load bearing post and includes an upper supporting block for supporting the laterally outside portion of the boat hull;

each said central load bearing post comprising the upper load bearing block secured to a depending vertically adjustable load bearing member operatively supported by structural members secured to a base plate for resting on the ground;

each said outside support stand comprising the upper support block secured to a biased vertically adjustable support member biased to a vertical line and operatively supported by a plurality of supporting means adapted to rest on the ground, the supporting means comprising inside supporting means and outside supporting means where the inside supporting means are shorter than the outside supporting means, said inside supporting means skewed slightly inwardly relative to the vertical line and said outside supporting means skewed considerably inwardly relative to the vertical line where the inside supporting means is skewed less than the biased adjustable support member and the outside supporting means is skewed more than the biased adjustable support member, whereby the outside support stand supports the boat hull on a bias skewed with the vertical line; and each said central load bearing post having a lateral cable means connected to the base plate thereof and further connected to the upper structural part of each outside supporting stand, and each said central load bearing post interconnected with the adjacent central load bearing post of the adjacent sub-system assembly by a central cable means.

20. The boat shoring system in claim 19 where each center cable means and each lateral cable means is detachable and adjustable with the respective central load bearing posts and the outside supporting stands.

21. The boat shoring system in claim 19 comprising two sub-system assemblies for supporting the forward two-thirds of the boat hull and a rearward combination of three laterally spaced stern load bearing posts where the central stern post is a central stern load bearing post, and said stern load bearing posts are interconnected with stabilizing cable means.

* * * * *

UNITED STATES PATENT AND TRADEMARK OFFICE

CERTIFICATE OF CORRECTION

PATENT NO. : 4,759,660

DATED : July 26, 1988

INVENTOR(S) : REG D. CORBETT

It is certified that error appears in the above-identified patent and that said Letters Patent is hereby corrected as shown below:

Column 5, line 14, after "hull" should be a ---.---;

Column 7, line 11, "sharing" should read ---shoring---.

Signed and Sealed this

Fifteenth Day of November, 1988

*Attest:*

DONALD J. QUIGG

*Attesting Officer*

*Commissioner of Patents and Trademarks*